US008376044B2

(12) United States Patent
Ostevik

(10) Patent No.: US 8,376,044 B2
(45) Date of Patent: Feb. 19, 2013

(54) PLUG DEVICE

(75) Inventor: John Arild Ostevik, Hafrsfjord (NO)

(73) Assignee: Aker Well Service AS (NO)

( * ) Notice: Subject to any disclaimer, the term of this patent is extended or adjusted under 35 U.S.C. 154(b) by 530 days.

(21) Appl. No.: 12/532,985

(22) PCT Filed: Mar. 13, 2008

(86) PCT No.: PCT/NO2008/000094

§ 371 (c)(1),
(2), (4) Date: Jan. 29, 2010

(87) PCT Pub. No.: WO2008/118021

PCT Pub. Date: Oct. 2, 2008

(65) Prior Publication Data

US 2010/0126714 A1 May 27, 2010

(30) Foreign Application Priority Data

Mar. 28, 2007 (NO) ..... 20071624

(51) Int. Cl.
*E21B 33/12* (2006.01)

(52) U.S. Cl. ..... 166/192; 166/179; 166/196

(58) Field of Classification Search ..... 166/179, 166/135, 192, 138, 216, 196; 277/330, 339; 138/89, 90

See application file for complete search history.

(56) References Cited

U.S. PATENT DOCUMENTS

| | | | | |
|---|---|---|---|---|
| 1,507,983 | A | 9/1924 | Anderson | |
| 2,197,222 | A | 4/1940 | Norman et al. | |
| 2,294,521 | A * | 9/1942 | Steadman et al. | 175/247 |
| 2,672,200 | A | 3/1954 | Patterson | |
| 2,780,294 | A | 2/1957 | Loomis | |
| 2,781,854 | A * | 2/1957 | Boer et al. | 166/187 |
| 2,850,339 | A * | 9/1958 | Vincent | 417/59 |
| 3,451,583 | A * | 6/1969 | Lee | 220/233 |
| 3,604,591 | A * | 9/1971 | Seltzer | 220/284 |
| 4,403,660 | A * | 9/1983 | Coone | 166/387 |
| 6,827,150 | B2 * | 12/2004 | Luke | 166/387 |
| 2007/0068671 | A1 | 3/2007 | Lohbeck | |

OTHER PUBLICATIONS

International Search Report for parent application PCT/NO2008/000094, having a mailing date of Jun. 26, 2008.

* cited by examiner

*Primary Examiner* — David Andrews
*Assistant Examiner* — Taras P Bemko
(74) *Attorney, Agent, or Firm* — Andrus, Sceales, Starke & Sawall, LLP

(57) ABSTRACT

A plug device for closing of a pipe bore where the plug comprises an exterior sleeve formed in a flexible material, and a setting mechanism, and where the setting mechanism comprises wedges which between their passive position and their active position are displaced along a curved path.

18 Claims, 4 Drawing Sheets

PLUG DEVICE

CROSS-REFERENCE TO RELATED APPLICATIONS

This application is the U.S. national stage application of International Application No. PCT/NO2008/000094, filed Mar. 13, 2008, which International application was published on Oct. 2, 2008, as International Publication No. WO 2008/118021 A1 in the English language, which application is incorporated herein by reference. The International application claims priority of Norwegian Patent Application No. 20071624, filed Mar. 28, 2007, which application is incorporated herein by reference.

BACKGROUND

This invention relates to a plug. More particularly it concerns a plug for closing of a pipe bore where the plug comprises an external sleeve made from a flexible material, and a setting mechanism, and where the setting mechanism comprises wedges which between their passive position and their active position run along a curved path.

Pipe bores in this context also comprise unlined boreholes in the ground.

During e.g. exploitation of petroleum, plugs that can be set for closing of a pipe bore are often used. Known plugs typically comprise one or more relatively thick cylindrical bodies made of an elastic material. When the plug is to be set, the bodies are squeezed axially such that they expand radially outwards against the pipe wall.

Plugs according to prior art exhibit some weaknesses. During setting, the position of the plug is unstable by the very fact that the plug end portions are displaced toward each other during the setting. Further, the relatively large mass of elastic material causes that so-called extrusion may occur. During extrusion, some of the flexible material is, due to differential pressure across the plug, squeezed out between the pipe bore and one end portion of the plug, whereby leaks can occur.

When prior art plugs are to be removed, they normally have to be drilled out.

SUMMARY

The object of the invention is to remedy or reduce at least one of the prior art drawbacks.

The object is achieved according to the invention by the features given in the description below and in the following claims.

In accordance with the invention a plug for closing a pipe bore where the plug comprises an exterior sleeve made of an elastic material, and a setting mechanism, is characterized in that the setting mechanism comprising wedges which between their passive position and their active position run along a curved path. The wedges being displaced along a curved path achieve an extended wedge travel inside a certain axial is length.

The curved paths for each of the wedges are preferably in a plane parallel to the plug longitudinal axis, but may also be constituted by an e.g. helical shaped path.

Advantageously, the wedges are arranged in a first set of wedges and a second set of wedges where each wedge in the first set of wedges is between two adjacent wedges in the second set of wedges. The wedges in the first set of wedges, respectively the second set of wedges, have their rise in opposite directions.

The wedges may be designed as a whole body, or it may be constituted by several components, by for example being split longitudinally into two parts, or that the wedge inside and outside is made from different materials.

The setting mechanism may comprise more than two sets of wedges.

The first set of wedges and the second set of wedges are arranged to be displaced in opposite directions during activation.

It is expedient that the two sets of wedges together form an outside shell being essentially continuous at the largest diameter of the shell surface, see the specific part of the description.

To achieve the intended effect, the wedges inside abut a curved, preferably ball shaped body.

To reduce the friction against the wedges during setting, it is advantageously provided a number of ribs running in the longitudinal direction of the plug, spaced along the inside is shell surface of the sleeve.

The setting mechanism is typically a synchronous displacement arrangement coupled to the first and second sets of wedges respectively. A preferred embodiment of the synchronous displacement arrangement where the setting mechanism is mechanically activated is described in the specific part of the application. The plug may however relatively easily be adapted to being set by means of a supplied pressurized fluid, or by means of a pyrotechnic charge.

It is also relatively simple to arrange the setting arrangement with a releasable lock so that the setting arrangement is releasable.

The invention provides a plug comprising relatively little elastic material and where the displacement length of the wedges makes possible a relatively large expansion of the exterior sleeve. Moreover, the overall length of the plug remains unchanged during setting.

BRIEF DESCRIPTION OF THE DRAWINGS

In the following is described an example of a preferred embodiment illustrated in the enclosed drawings, where.

DETAILED DESCRIPTION OF THE DRAWINGS

Figure 1:
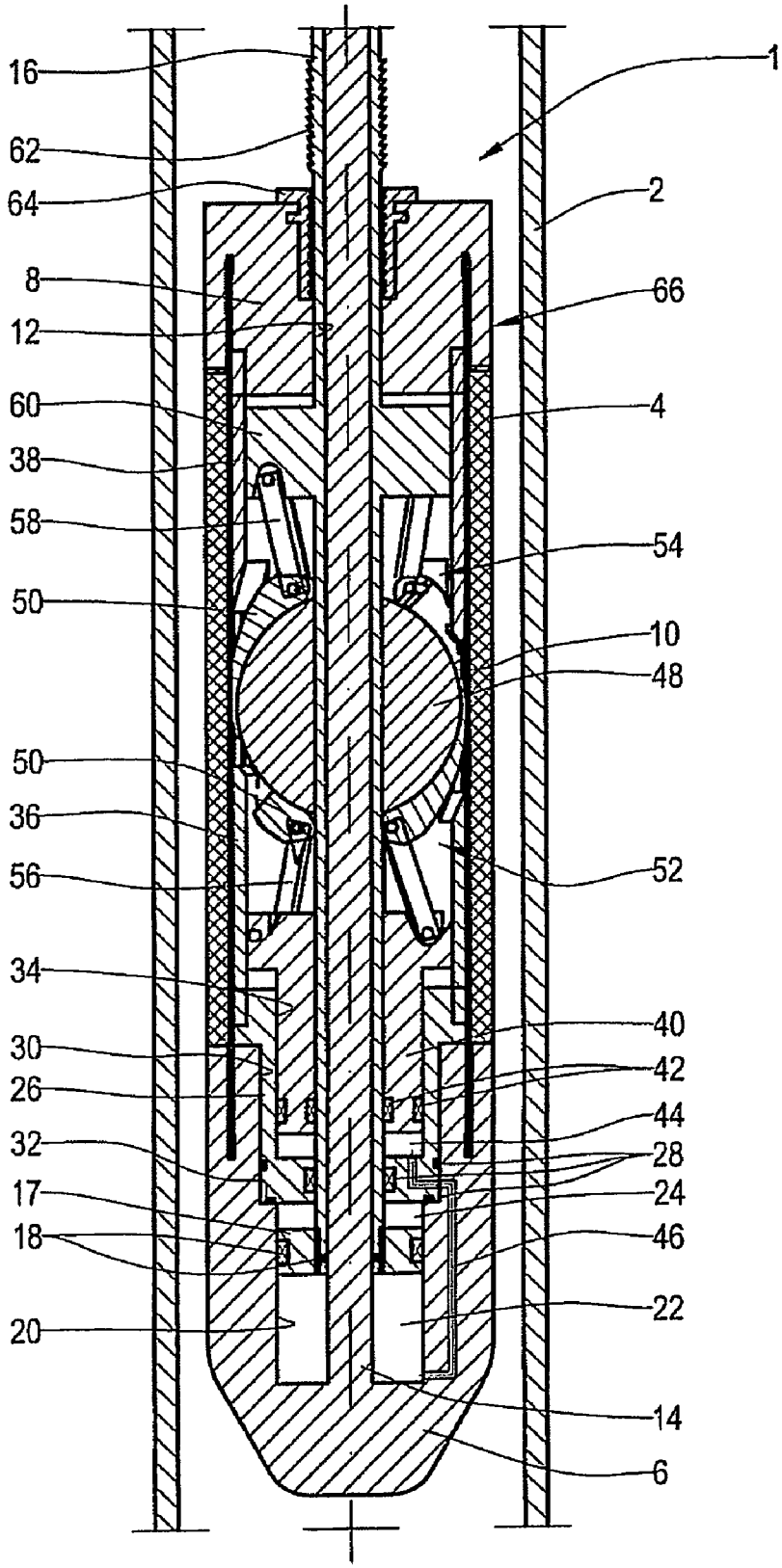
FIG. 1 shows a longitudinal section of a plug according to the invention before activation.
Figure 2:
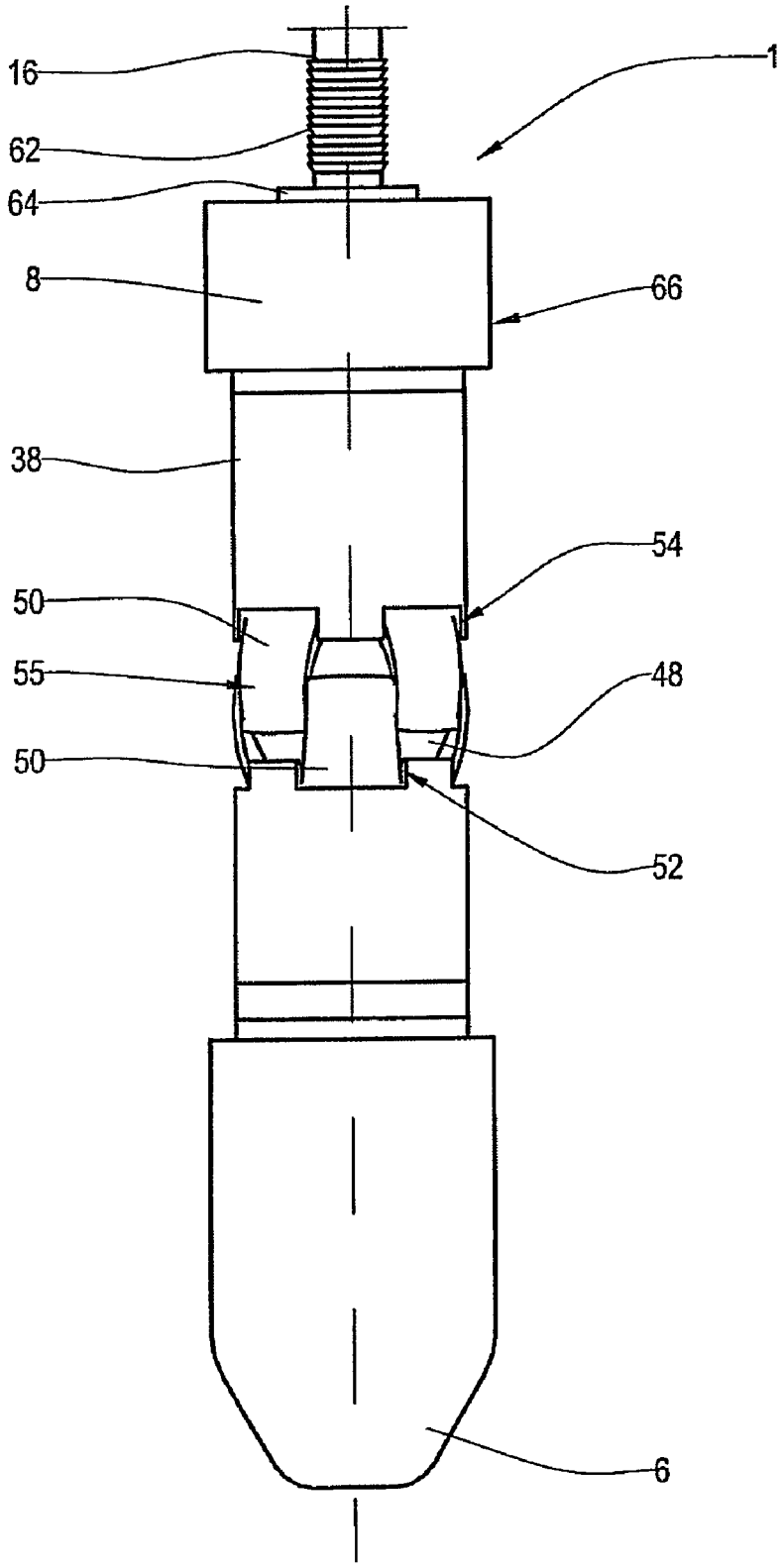
FIG. 2 shows a side view of the plug in FIG. 1, where an exterior sleeve with appurtenant ribs is removed.

In the drawings the reference numeral 1' refers to a plug positioned in a pipe 2. The plug 1 comprises a forward plug is housing 6 and a rear plug housing 8, in addition to an exterior sleeve 4 that is made of an elastic material.

The sleeve 4 runs between the forward plug housing 6 and the rear plug housing 8, the sleeve 4 abutting a number of ribs 10 distributed at the inner shell of the sleeve 4, and which runs between the plug housings 6, 8. The ribs 10 are in their respective end portions connected to the plug housings 6, 8.

The rear plug housing is provided with a centric through bore 12. A centric shaft 14 coupled to the forward plug housing 6 runs from the forward plug housing 6 via the bore 12 and to an actuator (not shown).

An activating sleeve 16 encircles the shaft 14 and runs from the actuator (not shown), via the bore 12 and on to a first piston 17 which by means of seals 18 is positioned sealingly displaceably in a first cylinder bore 20 in the forward plug housing 6.

A first cylinder space 22 is defined by the first cylinder bore 20, the shaft 14 and the first piston 17. A second cylinder space 24 is defined by the first cylinder bore 20, the first piston 17 and a cylinder sleeve 26 which by means of seals 28 form a sealing end wall for the first cylinder bore 20, and also by the activation sleeve 16.

The cylinder sleeve 26 is placed in a housing bore 30 in the forward plug housing 6 where a shoulder 32, against which the cylinder sleeve 26 abuts, is formed between the housing bore 30 and the first cylinder bore 20.

The cylinder sleeve 26 is provided with a second cylinder bore 34, which is concentric with the first cylinder bore 20. A first guide sleeve 36 is concentrically coupled to the cylinder sleeve 26 and extends out from this in a direction towards the rear plug housing 8. A corresponding second guide sleeve 38 is coupled to the rear plug housing 8 and extends out in the direction of the first guide sleeve 36. The guide sleeves 36, 38 are positioned inside the ribs 10.

A second piston 40 encircling the activation sleeve 16 is Provided with seals 42, the second piston 40 being displaceably placed in the second cylinder bore 34. The second piston 40 runs displaceably in the first guide sleeve 36, the first guide sleeve 36 providing a guide for the second piston 40.

A third cylinder space 44 is defined by the second cylinder bore 34, the second piston 40 and the activation sleeve 16. The first cylinder space 22 and the third cylinder space 44 communicate via a channel 46, their cross-sectional areas being equal.

A ball-shaped body 48 displaceably encircles activation sleeve 16 in a portion between the first guide sleeve 36 and the second guide sleeve 38. A number of wedges 50 abutting the ball-shaped body 48 are distributed in a first set of wedges 52 encircling the activation sleeve 16 on the side of the ball-shaped body 48 facing the forward plug housing 6, and a second set of wedges 54 encircling the activation sleeve 16 on the opposite side of the ball-shaped body 48.

The narrowest portion of the wedges 50 in the first set of n wedges 52 faces the narrowest portion of the wedges 50 in the second set of wedges 54. Together the wedges 50 in the first set of wedges 52 and the second set of wedges 54 form an exterior shell surface 55 which is essentially continuous around the largest diameter of the shell surface 55.

The wedges 50 in the first set of wedges 52 are articulated coupled to the second piston 40 by means of a first link arm 56 each, while the wedges 50 in the second set of wedges 54 are articulated coupled to the activation sleeve 16 by means of a second link arm 58 each and a guide flange 60. The sec- and guide sleeve 38 provides a guide for the guide flange 60, which is a part of the activation sleeve 16.

The activation sleeve 16 is, adjacent the rear plug housing B, provided with saw-tooth-formed ratchets 62 which complimentary fit in a locking sleeve 64 encircling the activation sleeve 16.

The locking sleeve 64 is in a per se known way shaped to be released by being turned about its longitudinal axis. The locking sleeve 64 may be made of a relatively brittle material that may be deactivated by crushing for example by means of a stroke.

When the plug 1 is to be set in the pipe 2, the actuator (not shown) applies a force in the direction towards the forward plug housing on the activation sleeve 16 relative to the centric shaft 14 which is held back.

The activation sleeve 16 with the guide flange 60 and the first piston 17 is thereby displaced inwards on the centric shaft 14. Liquid present in the first cylinder space 22 flows via the channel 46 and into the third cylinder space 44. The second piston 40 is, due to the first cylinder space 22 and the third cylinder space 44 having equal cross-sectional areas, thereby brought to be displaced towards the ball-shaped body 48 with the same speed as the guide flange 60 is displaced towards the body 48, but in the opposite direction.

Figure 3:
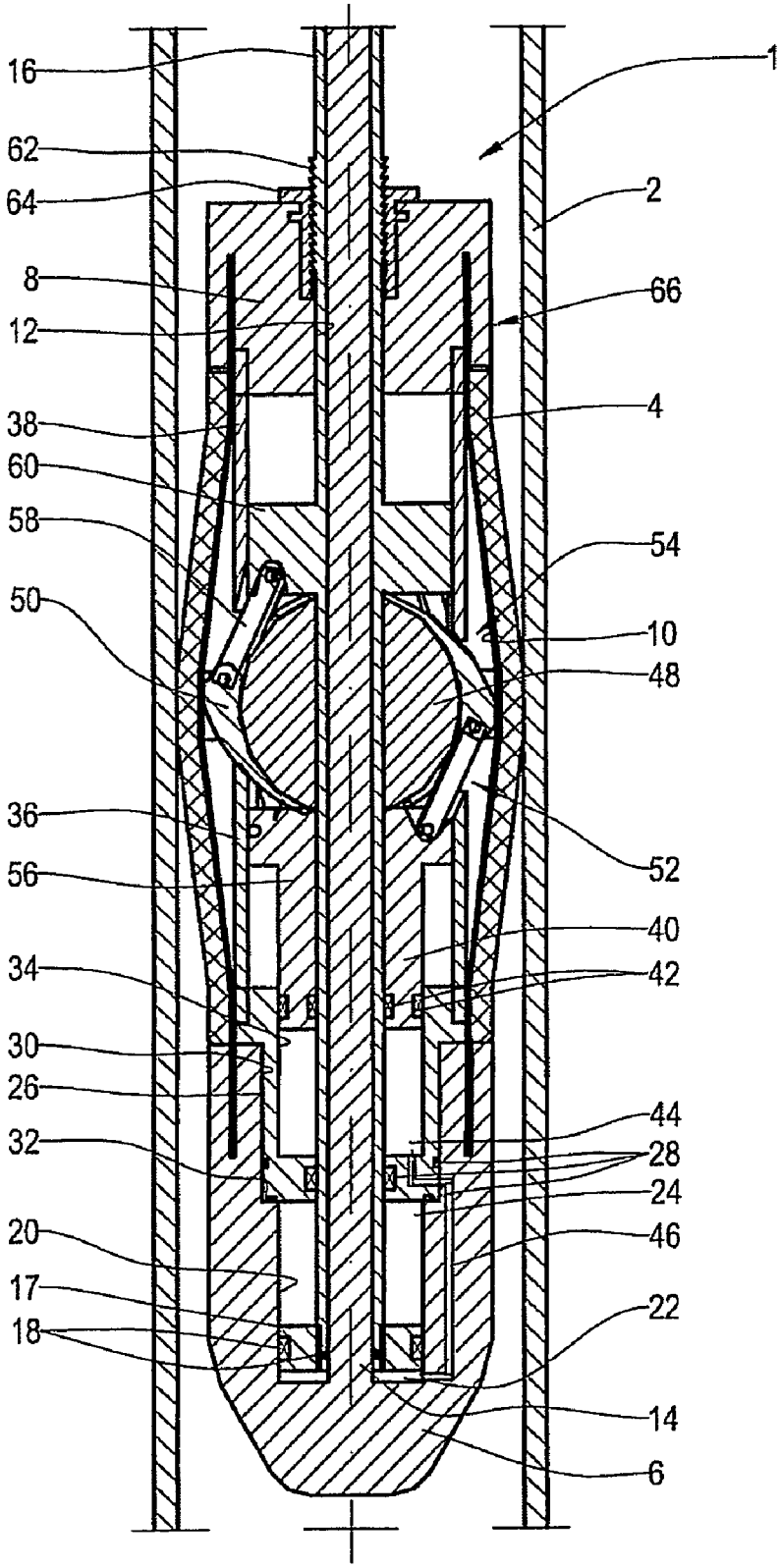
FIG. 3 shows a longitudinal section of the plug in FIG. 1 in the activated condition.
Figure 4:
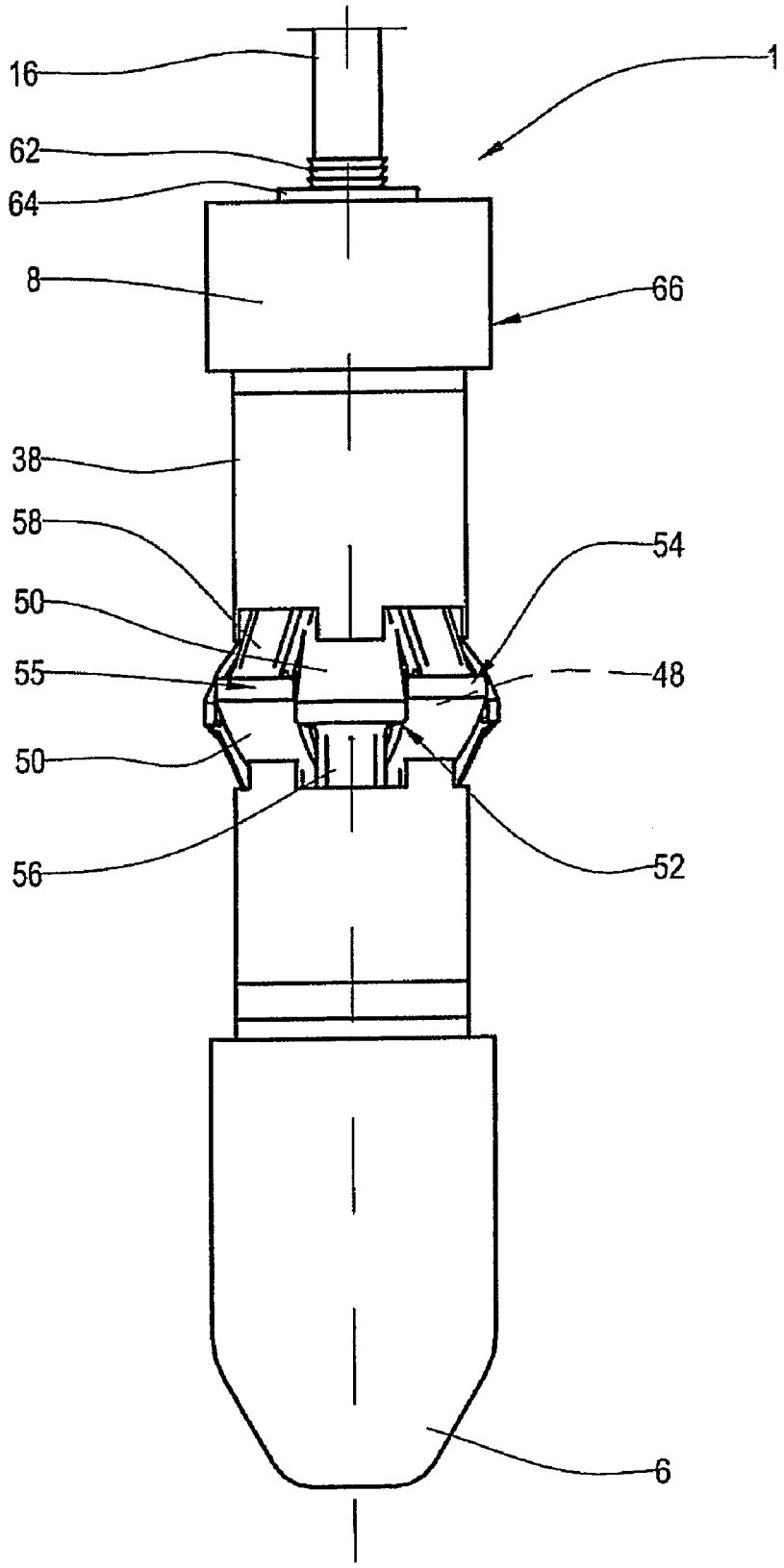
FIG. 4 shows a side view of the plug in FIG. 1, but where the sleeve and the ribs are removed.

The wedges 50 belonging to the first set of wedges 52 are thereby displaced synchronously about the ball-shaped body 48 in between the wedges 50 of the second set of wedges 54. The outside diameter of the exterior shell surface 55 of the wedges 50 is thereby increased. The thicker portions of the wedges 50 thereby displace the ribs 10 outward, whereby the exterior sleeve 4 is forced sealingly against the pipe 2, see FIG. 3.

The ratchets 62 are at the same time being lockingly displaced into the locking sleeve 64. The plug 1 is thereby sealingly locked in the pipe 2 until the locking sleeve 64 is released so that the activation sleeve 16 may be displaced back.

The setting mechanism 66 of the plug 1 is made up of the components 6 to 64.

It is also possible to pump pressure fluid via channels (not shown) into the second cylinder space 24, whereby the fluid pressure acting against the first piston 1617 displaces the activation sleeve 16 in over the shaft 14.

A pyrotechnical charge in the second cylinder space 24 would exert the same effect.

The invention claimed is:

1. A plug device for closing a pipe bore, the plug device comprising:

a sleeve made of elastic material;

a shaft axially extending through the sleeve;

a curved body;

a setting mechanism that moves first and second sets of wedges along an outer surface of the curved body between an active position for extending the sleeve to plug the pipe bore and a passive position to unplug the pipe bore;

wherein each wedge in the first and second sets of wedges has a first end that is pivotably coupled to a respective link arm, a second end, and an inside surface between the first and second ends, the inside surface abutting the outer surface of the curved body during movement between the active and passive positions;

wherein during movement toward the active positions the second end of each wedge is displaced radially along a curved path towards the shaft; and wherein during movement toward the passive position the second end of each wedge is displaced radially along the curved path away from the shaft.

2. The plug device according to claim 1, wherein the first set of wedges is interdigitated with the second set of wedges.

3. The plug device according to claim 1, wherein each wedge in the first and second sets of wedges has an ascent, and wherein the ascents of the first set of wedges are distal from the ascents of the second set of wedges.

4. The plug device according to claim 1, wherein the first set of wedges moves from the passive position to the active position in a first axial direction and wherein the second set of wedges moves from the passive position to the active position in a second, axially opposite direction.

5. The plug device according to claim 1, wherein the first and second sets of wedges in the active position together form a shell surface that has an outer diameter that is continuous.

6. The plug device according to claim 1, wherein the curved body is sphere shaped.

7. The plug device according to claim 1, comprising a plurality of ribs along an interior surface of the sleeve, the ribs reducing friction between the sleeve and the first and second sets of wedges.

8. The plug device according to claim 1, wherein the setting mechanism comprises a releasable lock.

9. A plug device for closing a pipe bore, the plug device comprising:

a sleeve made of elastic material;

a shaft axially extending through the sleeve;

a curved body;

a setting mechanism that moves first and second sets of wedges along an outer surface of the curved body between an active position for extending the sleeve to plug the pipe bore and a passive position to unplug the pipe bore;

wherein each wedge in the first and second sets of wedges has a first end that is pivotably coupled to a respective link arm, a second end and an inside surface between the first and second ends, the inside surface abutting the outer surface of the curved body during movement between the active and passive positions;

wherein between the active and passive positions the second end of each wedge is displaced radially along a curved path towards and away from the shaft, respectively;

wherein the setting mechanism comprises a displacing device coupled to the first and second sets of wedges, the displacing device configured to move the first and second sets of wedges in synchrony with each other between the respective active and passive positions.

10. A plug device for closing a pipe bore, the plug device comprising:

a sleeve made of elastic material;

a shaft extending through the sleeve;

a curved body;

first and second sets of wedges each having an inside surface abutting the curved body;

a setting mechanism that moves first and second sets of wedges along a curved path defined by an outer surface of the curved body between an active position for extending the sleeve to plug the pipe bore and a passive position to unplug the pipe bore;

wherein the setting mechanism moves the first and second sets of wedges in synchrony with each other.

11. A plug device for closing a pipe bore, the plug device comprising:

a sleeve made of elastic material;

a shaft extending through the sleeve;

a curved body;

first and second sets of wedges each having an inside surface abutting the curved body;

a setting mechanism that moves first and second sets of wedges along a curved path defined by an outer surface of the curved body between an active position for extending the sleeve to plug the pipe bore and a passive position to unplug the pipe bore;

wherein during movement toward the active position the second end of each wedge is displaced radially along the curved path towards the shaft; and wherein during movement toward the passive position the second end of each wedge is displaced radially along the curved path away from the shaft.

12. The plug device according to claim 11, wherein each entire wedge of the first and second sets of wedges moves along the curved path.

13. The plug device according to claim 11, wherein in the active position a thickest portion of each wedge in the first and second sets of wedges is disposed between the curved body and the sleeve.

14. The plug device according to claim 11, wherein the first set of wedges moves from the passive position to the active position in a first direction and wherein the second set of wedges moves from the passive position to the active position in a second, opposite direction.

15. The plug device according to claim 11, wherein each wedge in the first and second sets of wedges has a first end that is pivotably coupled to a respective link arm, and a second end, the inside surface abutting the curved body during movement between the active and passive positions.

16. The plug device according to claim 11, wherein the first set of wedges is interdigitated with the second set of wedges.

17. The plug device according to claim 11, wherein each wedge in the first and second sets of wedges has an ascent, and wherein the ascents of the first set of wedges are opposed to the ascents of the second set of wedges.

18. The plug device according to claim 11, comprising at least one fluid-activated piston moving the first and second sets of wedges.

* * * * *